United States Patent [19]

Schächter

[11] Patent Number: 4,680,007

[45] Date of Patent: Jul. 14, 1987

[54] LIGHTER WITH ADJUSTABLE FLAME

[76] Inventor: Friedrich Schächter, Draschestrasse 31, Vienna, Austria, A-1232

[21] Appl. No.: 728,075

[22] Filed: Apr. 29, 1985

[51] Int. Cl.[4] ..... F23D 13/04

[52] U.S. Cl. ..... 431/344

[58] Field of Search ..... 431/131, 150, 344; 222/3

[56] References Cited

U.S. PATENT DOCUMENTS

| | | | |
|---|---|---|---|
| 2,675,205 | 4/1954 | Fortin | 251/121 |
| 2,732,699 | 1/1956 | Ward | 67/7.1 |
| 3,092,988 | 6/1963 | Meyers | 67/7.1 |
| 3,165,908 | 1/1965 | Kihara | 67/7.1 |
| 3,326,242 | 6/1967 | Parkison | 138/46 |
| 3,418,821 | 12/1968 | Remy et al. | 62/52 |
| 3,471,246 | 10/1969 | Piffath et al. | 431/150 |
| 3,589,851 | 6/1971 | Rabe | 431/131 |
| 3,592,237 | 7/1971 | Borschers | 138/43 |
| 3,597,140 | 8/1971 | Rabe | 431/131 |
| 3,663,152 | 5/1972 | Yoshida | 431/344 |
| 3,695,819 | 10/1972 | Tricot | 431/344 |
| 3,697,002 | 10/1972 | Parkison | 239/535 |
| 3,705,785 | 12/1972 | Goto | 431/344 |
| 3,761,221 | 9/1973 | Stillions | 431/18 |
| 3,766,946 | 10/1973 | Corarg | 138/44 |
| 3,794,583 | 2/1974 | Rhodes | 210/23 |
| 3,854,862 | 12/1974 | Webster | 431/254 |
| 3,860,385 | 1/1975 | Nakanishi | 431/344 |
| 3,867,090 | 2/1975 | Gili | 431/277 |
| 3,895,905 | 7/1975 | Nissen | 431/254 |
| 3,963,413 | 6/1976 | Lockwood et al. | 431/276 |
| 3,966,392 | 6/1976 | Lockwood | 431/344 |
| 4,008,992 | 2/1977 | Johnsson | 431/344 |
| 4,060,202 | 11/1977 | Neyret | 239/579 |
| 4,101,262 | 7/1978 | Neyret | 431/344 |
| 4,153,233 | 5/1979 | Neyret | 251/127 |
| 4,177,646 | 12/1979 | Guadagnin et al. | 62/52 |
| 4,224,020 | 12/1980 | Neyret | 431/244 |
| 4,243,377 | 1/1981 | Schmid | 431/344 |
| 4,332,549 | 6/1982 | Fuller | 431/344 |
| 4,352,658 | 10/1982 | Racek | 431/254 |
| 4,430,060 | 2/1984 | Racek | 431/276 |
| 4,478,570 | 10/1984 | Johannson | 431/344 |
| 4,496,309 | 1/1985 | Schachter | 431/344 |
| 4,560,345 | 12/1985 | Schächter | 431/344 |

FOREIGN PATENT DOCUMENTS

| | | | |
|---|---|---|---|
| 237355 | 12/1964 | Austria . | |
| 322883 | 6/1965 | Austria . | |
| 47708 | 3/1982 | European Pat. Off. . | |
| 51577 | 5/1982 | European Pat. Off. . | |
| 1457631 | 10/1969 | Fed. Rep. of Germany . | |
| 1457548 | 9/1972 | Fed. Rep. of Germany . | |
| 1457600 | 2/1973 | Fed. Rep. of Germany . | |
| 1952540 | 8/1973 | Fed. Rep. of Germany . | |
| 2622096 | 12/1976 | Fed. Rep. of Germany | 431/344 |
| 2277305 | 1/1976 | France | 431/344 |
| 2303239 | 10/1976 | France . | |
| 2313639 | 12/1976 | France . | |
| 2313638 | 12/1976 | France | 431/344 |
| 2389834 | 1/1979 | France | 431/344 |
| 2397599 | 2/1979 | France . | |
| 2410221 | 6/1979 | France . | |
| 2417723 | 9/1979 | France . | |

(List continued on next page.)

OTHER PUBLICATIONS

Brochure entitled "Celgard" Technical Information-Film, Celanese Corporation, 1985.

W. Schneider, "Vapor Flow Through a Porous Membrane", *Acta Mechanica,* 47, 15–25 (1983).

*Primary Examiner*—Margaret A. Focarino

*Attorney, Agent, or Firm*—Pennie & Edmonds

[57] ABSTRACT

A fuel burning lighter having an adjustable flame height comprising burner means, a supply of liquified gaseous fuel, valve means positioned between the fuel supply and the burner means, and a film having a plurality of micropores oriented substantially perpendicular to its surface. The film is positioned between the valve means and the fuel supply in such a manner so that all fuel flowing to the burner means must pass through the micropores. The lighter also includes means for conducting fuel passing through the film through the valve means to the burner means, and control means to selectively increase or decrease the passage of fuel through the film to the burner means so as to provide a flame of desired height.

17 Claims, 6 Drawing Figures

FOREIGN PATENT DOCUMENTS

| | | | |
|---|---|---|---|
| 2442404 | 6/1980 | France . | |
| 2444891 | 7/1980 | France . | |
| 2467356 | 4/1981 | France . | |
| 2468837 | 5/1981 | France . | |
| 2520487 | 7/1983 | France . | |
| WO84/1812 | 5/1984 | PCT Int'l Appl. . | |
| 452964 | 5/1968 | Switzerland . | |
| 728320 | 4/1955 | United Kingdom | 431/150 |
| 2029558 | 3/1980 | United Kingdom . | |
| 2043858 | 10/1980 | United Kingdom . | |
| 2099561 | 12/1982 | United Kingdom . | |

LIGHTER WITH ADJUSTABLE FLAME

TECHNICAL FIELD

The invention relates to a lighter, particularly a disposable pocket lighter, wherein the flame height is adjustable, particularly to compensate for pressure variations due to temperature changes.

BACKGROUND ART

In fixed flame disposable lighters, manufacturing inconsistencies caused significant deviations of the flow rate of the fuel from the desired rate. Moreover, the influence of the gas vapor pressure has a more significant effect on the flame height when the temperature increases. Since the manufacturing inconsistencies of the metering material and the temperature influence are compounded, the user is frequently startled by an unexpectedly high flame. This represents a substantial safety problem because a startle reaction of the user might cause accidents. In other instances, the flame is unexpectedly low, in which case the lighter may be ineffective.

To attempt to resolve this problem, a majority of the low priced disposable lighters offered on the world market have a mechanism which permits the user to control the flame height. As a result, the manufacturing costs are increased, and the safety problem is still not solved because the necessity of reducing the flame height is recognized only after the startled reaction.

In the mass production of lighters without flame regulating devices, an important problem resides in controlling the flame height in such a manner that the flame height does not deviate more than plus or minus (i.e. +/−) 10% as compared to a desired value under equal temperature conditions. However, due to the temperature dependency of the vapor pressure in the lighter fuel tank, the amount of gas discharged inevitably increases. Thus the flame height increases with rising temperature.

For example, assuming a normal flame with a height of 25 mm at 25° C. and 2.5 bars pressure, a temperature increase to 50° C. results in an increase of the pressure to 5 bars when isobutane gas is used. This, as well as an additional, nonlinear, increased permeability of the metering material caused for example, by thermal expansion, leads to an increase of the flame height to 50 to 70 mm. If the observed change of the flame height at a desired temperature change is defined as flame index, and if the index value 1 is assigned to an increase of the flame from 25 to 50 mm when the temperature rises from 25° to 50° C., a flame height increase from 25 to 70 mm would correspond to a flame index of 1.8.

Experience has shown that in known lighters the aging in the unused state additionally leads to an irreversible change of the original flame height. This is particularly true when the lighters are subjected to changing or extreme ambient conditions, and when the metering material and its supporting structure have different thermal expansion rates.

Also, a flickering of the flames can be frequently observed. This is particularly true for pocket lighters which are subjected to very different temperatures and are frequently in a completely undefined carrying position immediately prior to being used.

My U.S. Pat. No. 4,496,309 resolves this problem within the framework of non-adjustable lighters. The content of this patent is expressly incorporated herein by reference.

The present invention avoids the disadvantages described hereinabove by providing a lighter with flame adjustability, combined with consistent and stable gas flow and reduced production costs.

SUMMARY OF THE INVENTION

The invention relates to a fuel burning lighter having an adjustable flame height comprising burner means, a supply of liquified gas fuel, valve means positioned between the fuel supply and the burner means, and a film having a plurality of micropores oriented substantially perpendicular to its surface. The film is positioned between the valve means and the fuel supply in such a manner so that all fuel flowing to the burner means must pass through the micropores. The lighter includes means for conducting fuel passing through the film through the valve means to the burner means, and control means to selectively increase or decrease the passage of fuel through the film to the burner means so as to provide a flame of desired height.

The film is deflectable between a rest position when the valve means is closed, and a deflected position not exceeding the yield point of the film when the valve means is open. The control means is located adjacent the film for increasing or decreasing contacting relation therewith.

In an alternate embodiment, the control means is movable to positions corresponding to increased or decreased contacting relation with the film so as to selectively prevent passage of fuel through the film, thereby controlling the amount of fuel to the burner means to provide a flame of desired height.

The supply of fuel comprises a first liquid portion, a gaseous portion, and a second liquid portion which is formed on the upstream surface of the microporous film when the lighter is operated in an upright position. The fuel comprising the second liquid portion is in the form of a thin liquid film. The fuel comprising this liquid film passes through the microporous film and is substantially completely vaporized as it leaves the downstream side of the microporous film to enter the conducting means.

In a preferred arrangement, the control means comprises a chamber located downstream of the microporous film. The upstream end of this chamber is defined by the microporous film and the downstream end includes surface means and the conducting means. The depth of the chamber is adjustable between predetermined minimum and maximum positions. The microporous film is capable of contact relation with the surface means, with the maximum position corresponding to minimum contact relation between the microporous film and surface means and the minimum position corresponding to maximum contact relation between the microporous film and surface means. The maximum contact relation further corresponds to a minimum flame height, while the minimum contact relation corresponds to an maximum flame height.

The depth of the chamber does not exceed a maximum distance beyond which said microporous film will be deflected past its yield point and is limited to a minimum distance beyond which said microporous film will be irreversibly compressed.

The conducting means comprises a centrally located aperture extending from the surface means to the valve means for conducting the fuel to the burner means. The surface means further comprises one or more grooves extending in a ray-like manner from the centrally located aperture to provide a predetermined minimum flame height. Preferably, these grooves have a substantially V-shaped cross-section.

In an alternate embodiment, the conducting means comprises a passage extending from the valve means to a point located beyond the area of the maximum contact relation between the microporous film and the surface means to conduct fuel which has passed through pores of the film. Here, the surface means may further comprise one or more grooves extending in a ray-like manner from the center of the surface means to provide a predetermined minimum flame height. Again, the grooves preferably have a substantially V-shaped cross-section.

Advantageously, the microporous film has a thickness of 25 micrometers and substantially discrete pores having a slot-like cross-section and an area of about 0.04 by 0.4 micrometers, and a preferred fuel is butane or isobutane.

BRIEF DESCRIPTION OF THE DRAWINGS

Further benefits and advantages of the invention will become apparent from a consideration of the following description given with reference to the accompanying drawings figures which specify and show preferred embodiments of the invention, and wherein.

For the sake of clarity, all portions or parts of these lighters which are not necessary for an explanation of the invention have been omitted.

DETAILED DESCRIPTION OF THE PREFERRED EMBODIMENTS

Figure 1:
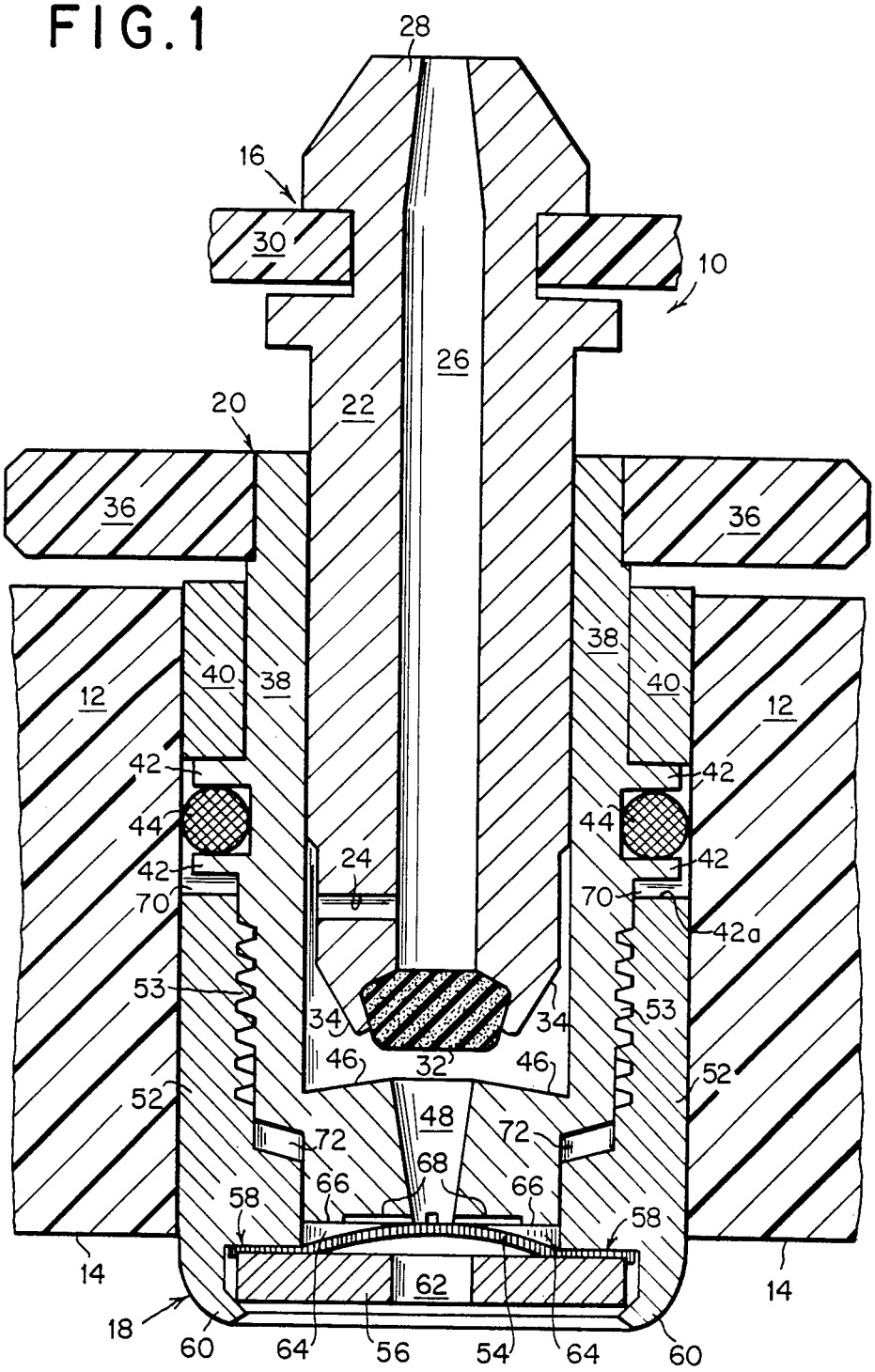
FIG. 1 is a partial cross-sectional view of a portion of a pocket lighter which illustrates a first embodiment of the invention.

Referring initially to FIG. 1, there is illustrated a fuel control and flame height adjusting mechanism 10 of a pocket lighter in accordance with the invention. This mechanism 10 is secured to the lighter body 12 in a gas tight manner such that the fuel, preferably butane or isobutane, cannot leak out of the lighter between the body 12 and the adjusting mechanism 10. This adjusting mechanism 10 extends through the ceiling 14 of the liquified gaseous fuel tank (not shown) here but see FIG. 3″ which is normally an extension of the side walls of body 12 and provided with a base part closing the tank hermetically.

A portion of the body 12 of the lighter together with a base part forms the hermetically sealed fuel tank and thus, must be constructed of a fuel compatible material. The preferred fuel is isobutane and various plastics such as Delrin 500 (a registered trademark of the Du Pont Company for their acetal resins) can be used for the body 12.

The fuel control and flame height adjusting mechanism 10 includes three main component parts. These are: a fuel valve assembly 16, a fuel flow proportioning member 18, and a flame height adjustment assembly 20.

As one skilled in the art would realize, when the valve is open, the fuel flows from the fuel tank, and, in sequence, through the lower part of the fuel flow proportioning member 18, the flame height adjusting assembly 20, and fuel valve assembly 16 to the tip of the burner tube 28 where a flame can be established by igniting the gaseous fuel in a manner that is well known in the art. Therefore, for explaining this invention, the term "upstream" will be used to designate components or sides of components which are first contacted by the fuel flowing from the fuel tank, while the term "downstream" will be used to designate components or sides of components which are subsequently contacted by fuel flowing to the burner tip.

The fuel valve assembly 16 includes a burner tube 22 having a gas conducting conduit 24 and gas conducting bore 26 for directing gaseous fuel to the burner tip 28. A valve seal 32 is secured to the upstream end of the fuel valve assembly 16 and is used to prevent or allow the gaseous fuel to pass from the valve bore 48 to the burner tip. The valve seal 32 is held in a closed position by a spring (not shown) which maintains the burner tube 22 in a closed position covering the valve bore 48. The valve seal can be opened by burner actuator 30 which opposes the force of the spring. A preferred material for the valve seal 32 is rubber, and it is held securely on the end of the burner tube by crimping the ends 34 of the tube 22 around the valve seal 32.

The burner tube 22 is made of an aluminum or copper alloy while the burner actuator 30 is made of molded plastic such as Delrin 500, a trademark of the Du Pont Company for their acetal resins.

The flame height adjusting assembly 20 includes a flame height adjusting ring 36 which is attached to one end of a flame height adjusting sleeve 38. The ring 36 and sleeve 38 are axially constrained by a flame height limiting sleeve 40. The sleeve 38 includes a circumferential channel portion 42 which is used to house an "O" ring gasket 44. This "O" ring 44 is maintained under compression so as to prevent escape of gaseous or liquid fuel. This sleeve 38 also includes an annular valve seat 46 for engaging the valve seal 32. This valve seat 46 has a centrally located valve bore 48 to allow passage of fuel. In FIG. 1, this valve bore 48 extends through the upstream sleeve end 38, while in FIG. 2, the bore 48 does not extend all the way through the sleeve end and instead contains a radial valve bore 50 which is directed to a side of the periphery of the sleeve end. The fuel reaches the radial bore 50 through a peripheral gap communicating with the porportioning chamber 64.

The fuel flow proportioning member 18 includes a socket 52, a microporous film 54 and a bracing disk 56. The socket 52 is, for example, made of an aluminum alloy. Into the upstream end of the socket 52 facing the fuel tank, there is advantageously formed recess surrounded by a flat bracing shoulder 58. The microporous film 54 is pressed by the bracing disk 56 against this bracing shoulder 58 in such a way that the circumference of the microporous film 54 is compressed to approximately half its thickness by the bracing shoulder 58, thereby becoming impermeable to fuel flow. The bracing disk 56 and the microporous film 54 proportioning disk are fixed in this state by flanging the edge of the socket 52 into a bracing lip 60. The bracing disk 56 has a generally central fuel aperture 62 for allowing passage of fuel.

The recess in the socket 52 is provided with a preferably cylindrical bore whose length is approximately 1 mm. The downstream side of the microporous film 54 along with the film contact face 66 which is located on the upstream end of sleeve 38, form the ends of a proportioning chamber 64 whose sides are formed by the side walls of the cylindrical bore in the recess. Preferably, the depth of the proportioning chamber 64 is variable between two and twenty times the thickness of the microporous film 54. The depth of the proportioning chamber 64, its cross-sectional area perpendicular to the axis of the film 54, the pressure differential between the fuel tank and the outside, the properties and thickness of the film 54 and the surface features of the face 66 determine the number of pores actively participating to allow passage of the amount of fuel delivered to the burner tip.

The fuel aperture 62 in the bracing disk 56 should be smaller than the diameter of the proportioning chamber in order to protect the film from damage during assembly. The thickness of the bracing disk 56 is approximately 0.5 mm.

It is advantageous to construct the bracing disk 56 of a metal material, preferably of an aluminum or copper alloy. The relatively high compressive strengths of these materials enable the bracing disk 56 to provide reliable bracing of the microporous film. At the bracing shoulder 58, the bracing disk 56 compresses the film 54 to about half its volume, thereby eliminating all pores and forcing the fuel to flow through a central portion of the film through the open pores into the proportioning chamber. Preferably, the socket 52 is made of the same material as the bracing disk 58, so that the thermal expansion of the parts surrounding the film 54 remain the same when the temperature varies.

Figure 6:
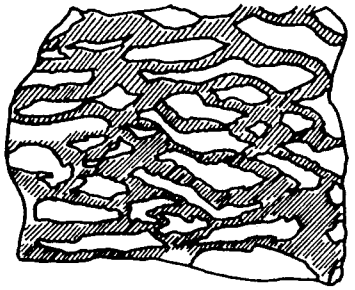
FIG. 6 is an enlarged view of the microporous membrane of the invention.

The pores of the microporous film 54 transport the fuel essentially perpendicularly to the surface. Particularly suitable for this purpose is a microporous, uniaxially stretched polypropylene film having a thickness of between 15 and 40 micrometers, preferably between 22 and 27 micrometers, and having pores of slot-like cross section with a cross-sectional area of about 0.04 by 0.4 micrometers produced during the stretching in the extrusion direction. This material has a porosity of about 44% of its total volume. At a gas vapor pressure of 1 to 6 bars, the amount of fuel flowing through this film is essentially proportional to the pressure. Such a material is sold at the present time by Celanese Plastics Company, 86 Morris Avenue, Summit, NJ, U.S.A., under the trade name "Celgard® 2500", and FIG. 6 illustrates the pores of this material.

In FIG. 1, the flame height adjusting sleeve 38 has a film contact face 66. This film contact face 66 may have any type of relative projecting and recessed portions. Advantageously, this face includes a plurality of radial grooves 68. Six grooves are preferably used, arranged in star-shape having a circumscribed diameter of 1.3 mm, but it is within the scope of the invention to choose any number of grooves and diameters. For example, four, five, or eight grooves may be provided. These grooves 68 are preferably coined in a single coining procedure, namely, by means of a coining tool which has several radially arranged ridges of V-shaped cross-section which form the desired shape e.g., the star.

Figure 4:
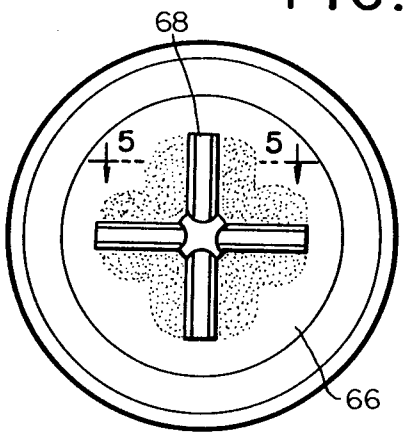
FIG. 4 is an enlarged bottom view of the proportioning chamber of the lighter taken along line 4—4 FIG. 3.
Figure 5:
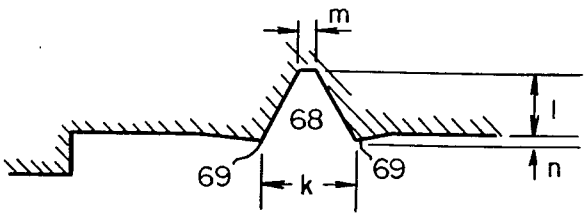
FIG. 5 is an enlarged sectional view of a radial groove taken along line 5—5 of FIG. 4.

FIG. 4 is an illustration of a film contact face having four of these V-shaped grooves 68, while FIG. 5 shows a cross-sectional of the grooves.

FIG. 5 shows on an enlarged scale, the depth 1 of the grooves 68 can be 0.09 mm, the opening can have a width k of 0.14 mm and the bottom m can have a width of 0.03 mm. The mound-like edge regions 69 adjacent to the sides of the groove 68 are somewhat rough because the structure of brass (containing about 2% lead for good cutting properties) is slightly broken during the coining step, i.e., the grain structure is disrupted. The resulting height n is about 0.01 mm.

The depth and diameter of the proportioning chamber 64 is coordinated with the flexibility of the elastically deformable microporous film 54 in such a way that the desired amount of gas is allowed to pass therethrough. For example, the depth of the proportioning chamber can be coordinated with the film contact face 66 in such a way that, if the gas pressure prevailing in the tank increases due to a temperature rise and the film 54 is thereby pressed against the contact face 66, an increasing portion of the pores of the film is prevented from actively participating in the passage of fuel to the burner tip 28. This is further influenced by the thermal expansion of the film. As a result, the flame height increases to a lesser extent than the increase of gas pressure and quantity of fuel flowing through the pores would have otherwise effected. When the proportioning disk material has a thickness of 25 micrometers, and the depth of the proportioning chamber 64 is adjusted to, for example, 0.08 to 0.12 mm, with the proportioning chamber having a diameter of from 1.8 to 1.9 mm and the star having a diameter of 1.3 mm, the flame height at a temperature of 25° C. will be about 25 mm. The above dimensions are with reference to a quality of "Celgard® 2500" whose porosity results in a measured value of 7.5 Gurley seconds in accordance with ASTM test method D-726, Model B. The variation of the depth of the chamber 64 provides the adjustability of the flame height by controlling the pores actively participating in the fuel flow.

The microporous film 54 is flexible because of its small thickness and its thermoplastic nature. Accordingly, the film 54 yields in the direction of the contact surface 66 under the flow pressure and portions of it rest against contact face 66. When the temperature and pressure increase and the valve is open, the elasticity of the film 54 causes it to rest with an increasingly large portion against the contact face 66 without exceeding the yield strength of the material. Therefore, a portion of the pores is stopped down, while at least the grooves 68 of the contact face 66 enable the fuel to flow toward the burner tip 28. At a lower temperature, after return to normal pressure, the film 54 again lifts off the portion of the contact face 66 whereupon the amount of fuel flowing through again exactly corresponds to the original amount, because no irreversible stretching or change of porosity have taken place.

In a typical lighter, a "Celgard® 2500" film with a Gurley value of 7.5 is used and mounted within a recess in a socket having a ring-shaped flat bracing shoulder with a diameter of 3.2 mm and an inner diameter of 1.85 mm which also constitutes the the diameter of the cylindrical side walls of the proportioning chamber 64. In this arrangement, a bracing disk with an external diameter of 3 mm is held in pressed engagement against the bracing shoulder 58. When the proportioning chamber 64 is adjusted to a depth of 0.1 mm, a device according to the invention produces a flame height of 25 mm (normal flame) at an ambient temperature of 25° C., using about 1 milligram of fuel per second. A change of the depth of the proportioning chamber leads to a proportional change of the flame height, so that within the temperatures normally encounted in use (from about 15° C. to about 50° C.), the flame height is adjustable between 10 and 70 mm.

The flame height is adjusted by rotating the flame height adjusting ring 36. This moves the flame height adjusting sleeve 38 to various positions within the flame height adjustment limiting gap 70. Such movement is accomplished by threaded engagement between sleeve 38 and socket 52, and is limited by the flame height limiting sleeve 40 on one end and the socket 52 on the other end. As shown in the drawings, a portion of the threads 53 are omitted from the sleeve 38 to provide thread clearance. Also, a clearance gap 72 is provided to facilitate movement of the sleeve 38.

Figure 2:
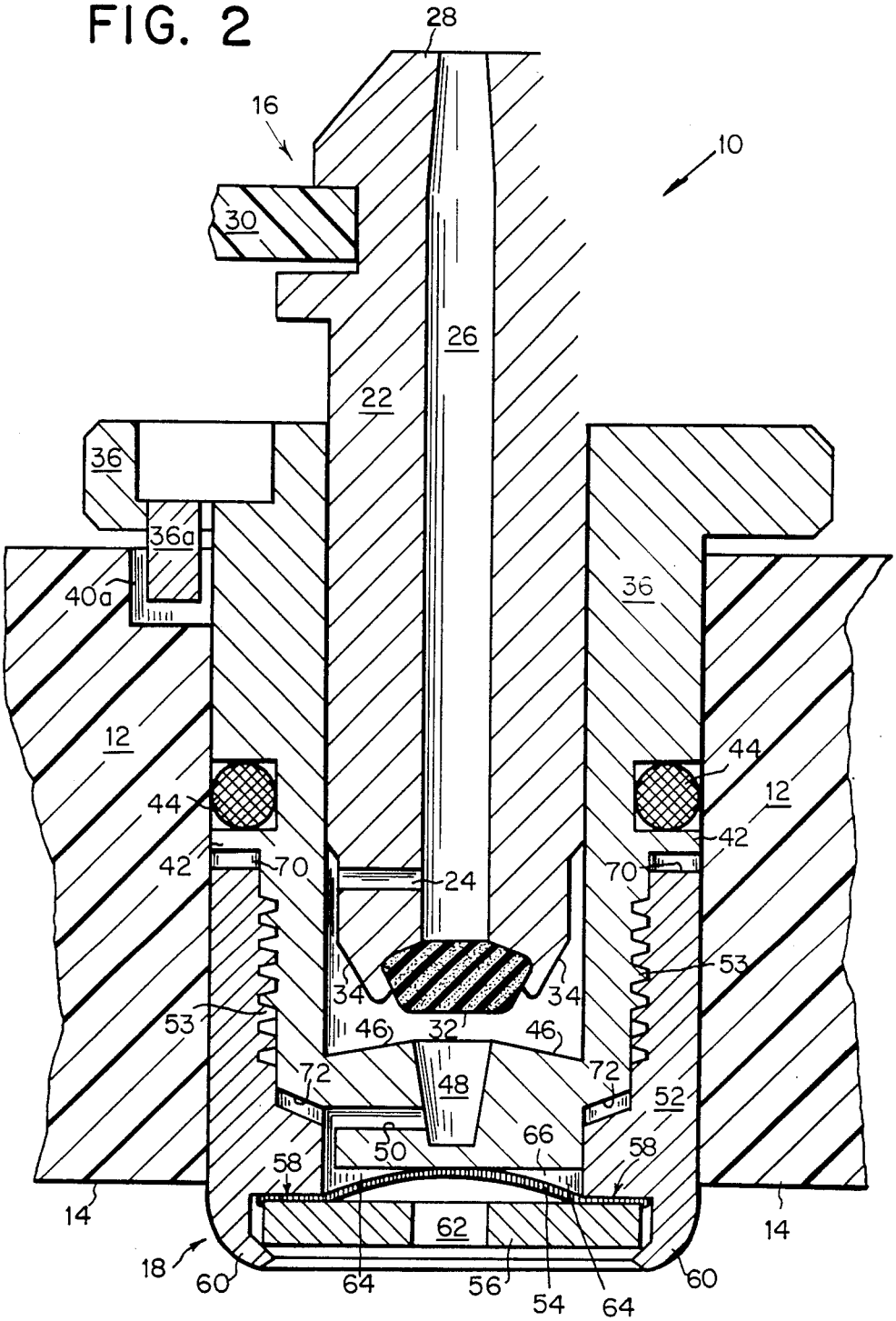
FIG. 2 is a partial cross sectional view similar to FIG. 1 but illustrating a second embodiment of the invention.

Alternatively, the stop for the maximum flame can be provided by limiting the rotation of adjusting ring 36 by providing a stop groove 40*a* and stop member 36*a*, as shown in FIG. 2. In this embodiment,, the adjusting ring 36 includes the adjusting sleeve which is made as an integral component. Stop member 36*a* may be integrally molded as part of adjusting ring 36 or it may be formed by cutting and displacing a portion of the material of ring 36*a* after assembly. Groove 40*a* is circular and preferably of a length which constrains rotation of the adjusting ring and sleeve 36 to about one third of a turn, or about 120°, when the pitch of threads 53 is such as to cause the desired maximum and minimum depth of proportioning chamber 64 when the adjusting ring 36 is rotated through its permitted range.

By "microporous" in this invention, it is meant a porosity of certain cross-section and length throughout the thicknesses of a film of suitable material which assures the formation of a thin layer or film of liquid fuel on the upstream side of the microporous film 54 when the lighter is operated in the upright positon and a head of fuel vapor is situated between the liquid fuel supply and the upstream side of the microporous film 54.

During operation of the lighter, the liquid fuel film flows through the pores and begins to vaporize into a gaseous state while flowing therethrough. Upon reaching the downstream face of the microporous film on its way to the burner tip, any remaining liquid fuel immediately vaporizes to the gaseous state.

The theory behind this phenomenon is explained in an article by W. Schneider entitled "Vapor Flow Through a Porous Membrane - A Throttling Process with Condensation and Evaporation," *ACTA MECHANICA,* 47, 15–25 copyright by Springer —Verlag 1983. This article is expressly incorporated by reference herein.

As is evident to one skilled in the art, lighters according to the invention have no dip pipe or wick. The lighters can be operated in an inclined position (for example, for lighting a pipe), with the flame becoming only insignificantly larger even though the liquid fuel reserve contacts the fuel aperture 62 and the microporous film 54 directly. This is also true when the burner tip 28 is positioned below the fuel reservoir liquid level.

Figure 3:
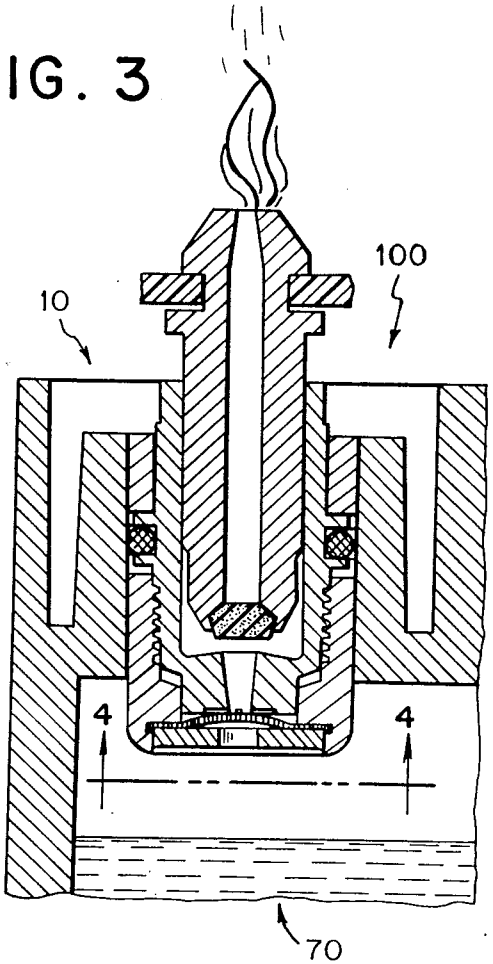
FIG. 3 is a partial cross sectional view of a lighter according to the invention.

FIG. 3 illustrates the flame height adjusting mechanism 10 of FIG. 1 in position in a lighter 100. When the lighter 100 is operated in an upright position, the liquid fuel 70 does not directly contact the fuel aperture 62 or microporous film 54.

A quiet and uniform burning of the flame in the normal, vertical position of operation is achieved by an arrangement of the flame height adjusting mechanism 10, which excludes a direct contact of the microporous film 54 with liquid fuel. When the lighter is moved from an undefined, for example, horizontal carrying position into a vertical position for ignition, the liquid fuel, with the exception of a residual amount retained by surface forces, flows back into the fuel tank. Furthermore, the flame can be stabilized after ignition especially quickly when the socket 52 of the fuel proportioning member 18 projects into the liquid-gas fuel tank in such a way that the size of the projection corresponds approximately to the level of the bracing shoulder 58, so that the proportioning disk 54 is located approximately in the plane of the liquid-gas tank ceiling 14 of the lighter body 12.

Finally, it is possible to construct the contact face 66 flat as shown in FIG. 2, or with any combination or shapes of projections and recesses.

The manufacturing costs to construct the device in accordance with the invention are substantially reduced by the fact that no large structural components are required which would lead to substantial costs for materials. Also, the costs for the mechanical finishing of the structural components are reduced because it is not necessary to remove great amounts of material. Also, it is not necessary to perform work with exacting requirements at locations which are not easily accessible, for example, in deep blind-end holes.

In addition, since the required small parts such as the bracing disk 56 and microporous film 54 are, for example, all arranged in very shallow recesses, the mounting of these parts is easily accomplished and can be performed with relatively simple devices. This makes unnecessary, for example, the preassembly of the membrane by means of ultrasonic welding as it is described for example, in French Pat. No. 2,313,638.

Moreover, the relatively small dimensions of the structural components prevent the occurrence of great thermal expansions or thermal tensions which impair the stability of the flame height due to both aging and possible loss of hermetically sealed fits. This effect can be further improved by suitable selection of materials which ensure, for example, a compatible thermal expansion coefficient for all structural components.

The usually occurring manufacturing inconsistencies which may lead to substantial differences in the flame height within one production series can be substantially improved in an economical manner by the device in accordance with the invention. The simplicity of the required structural components facilitates a high consistency in quality. The arrangement of all small parts in easily accessible, shallow recesses also reduces the probability of incorrect assembly.

Another advantage of the device according to the invention concerns the avoidance of changes of the flame height due to aging which frequently occurs even without use in prior art lighters. By using a microporous, uniaxially stretched polypropylene film, preferably of "Celgard ® 2500" without the use of a fiber layer or wick, a very high aging stability of the device according to the invention results.

The uniaxially stretched polypropylene film is deformable in the non-stretched direction, so that the amount flowing through could be influenced unintentionally. Therefore, it is preferable that the diameter of the valve bore 48 is of a very small size (for example, 0.4 mm on the upstream side) so that the microporous film 54 is prevented from being pressed into the bore 48 by fuel pressure.

In the production of lighters, such as, non-refillable pocket lighters, the filling amount of the liquid gas must be limited to approximately 80% of the volume of the fuel tank. During the filling procedure, the ambient temperature is about 20° to 25° C. This limitation to 80% is necessary for safety reasons because, during later storage or during the use of the lighters, the liquid fuel may lead to an explosion-like bursting of the tank in the case of substantially higher temperatures, such as, 60° C.

The fact that about 20% of the capacity of the tank must be occupied by the gaseous phase of the fuel is utilized in the lighters in accordance with the preferred embodiment in order to ensure that the proportioning disk and the components serving to brace the proportioning disk do not come into contact with the liquid level of the fuel when the lighter is used in the vertical position.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention. For example, the proportioning chamber and the fuel conducting means arrangement of FIG. 1 may be combined with the flame height limiting arrangement of FIG. 2. Also, since the energy balance of a lighter according to the invention is substantially unaffected by vaporization of the fuel passing adiabatically through the membrane to the burner tip, one is free to use any materials of construction regardless of their thermal conductivity properties. This is explained by the fact that the evaporation energy is consumed on the surface of the liquid fuel in the tank. Thus, plastics or metals can be used for any components as long as the heat of the flame itself has no effect. Other similar combinations and alternative arrangements can be made without departing from the scope of my invention.

What is claimed is:

1. A fuel burning lighter having an adjustable flame height comprising:
- burner means;
- a supply of liquified gaseous fuel;
- valve means positioned between said fuel supply and said burner means;
- a film having top and bottom generally parallel surfaces and micropores oriented substantially perpendicular to said surfaces, a plurality of said micropores of said film being open to allow passage of fuel, said film positioned between said valve means and said fuel supply in such a manner so that all fuel flowing to said burner means must pass through said open micropores;
- means for conducting fuel passing through said film and through said valve means to said burner means; and
- control means located downstream of said film comprising chamber means of adjustable depth whereby selectively increasing or decreasing the depth of the chamber means correspondingly increases or decreases said plurality of open micropores provided by deflection of the film thereby increasing or decreasing the passage of fuel through said film to said burner means so as to provide a flame of desired height.

2. The lighter of claim 1 wherein said film is deflectable between a rest position when said valve means is closed, and a deflected position not exceeding the yield point of said film when the valve means is open and said control means further comprises a contact means located adjacent the downstream surface of said film for increasing or decreasing contacting relation therewith.

3. The lighter of claim 1 wherein said supply of fuel comprises a first liquid portion, a gaseous portion, and a second liquid portion in the form of a thin liquid film which continuously forms on the upstream surface of said microporous film as long as the lighter is operated with said valve means opened, wherein fuel contained in said thin liquid film subsequently passes through said microporous film and is substantially completely vaporized as it enters said conducting means.

4. A fuel buring lighter having adjustable flame height comprising:
- burner means;
- a supply of liquified gaseous fuel;
- valve means positioned between said fuel supply and said burner means;
- a film having top and bottom generally parallel surfaces and micropores oriented substantially perpendicular to said surfaces, a plurality of said micorpores of said film being open to allow passage of fuel, said film positioned between said valve means and said fuel supply in such a manner so that all fuel flowing to said burner means must pass through said open micropores and said film being deflectable between a rest position and a deflected position;
- means for conducting fuel passing through said film through said valve means to said burner means; and
- control means located downstream of said film and movable to positions corresponding to increased or decreased contact relation with said film when said film is in said deflected position so as to selectively increase or decrease said plurality of open micorpores of said film, thus increasing or decreasing the passage of fuel through said film, thereby controlling the amount of fuel to said burner means to provide a flame of desired height.

5. A fuel burning lighter having adjustable flame height comprising:
- burner means;
- supply of liquified gaseous fuel comprising a first liquid portion, a gaseous portion, and a second liquid portion;
- valve means positioned between said fuel supply and said burner means;
- a microporous film having top and bottom generally parallel surfaces and micropores oriented substantially perpendicular to said surfaces, a plurality of said micropores of said film being open to allow passage of fuel, said film positioned between said valve means and said fuel supply in such a manner so that all fuel flowing to said burner means must pass through said open micropores;
- control means comprising a chamber having an adjustable depth, said chamber comprising wall means, one end of said wall means being closed by said microporous film, the opposite end of said wall means including surface means and said conducting means, said surface means contacted by said microporous film, and the depth of said chamber being adjustable between predetermined maximum and minimum positions respectively corresponding to a maximum and minimum flame height, wherein said second liquid portion of said fuel is in the form of a thin liquid film which continuously forms on the upstream surface of said microporous film as long as the lighter is operated with said valve means opened, wherein fuel contained in said thin liquid film subsequently passes through said microporous film and is substantially completely vaporized as it enters said conducting means; and wherein said control means is movable to positions corresponding to increased or decreased contacting relation with said microporous film so as to selectively increase or decrease said plurality of open micorpores, thus increasing or decreasing the passage of fuel through said microporous film, thereby controlling the amount of fuel to said burner means to provide a flame of desired height.

6. The lighter of claim 5 wherein the depth of the chamber does not exceed a maximum distance beyond which said microporous film will be deflected past its yield point and is limited to a minimum distance beyond which said microporous film will be irreversibly compressed.

7. A fuel burning ligher having an adjustable flame height comprising:

burner means;

a supply of liquified gaseous fuel;

valve means positioned between said fuel supply and said burner means;

a film having top and bottom generally parallel surfaces and micropores oriented substantially perpendicular to said surfaces, a plurality of said micropores of said film being open to allow passage of fuel, said film positioned between said valve means and said fuel supply in such manner so that all fuel flowing to said burner means must pass through said open micropores;

means for conducting fuel passing through said film and through said valve means to said burner means; and chamber means located downstream of said film, the upstream end of which is defined by said film and the downstream end including surface means and said conducting means, said chamber means having a depth which is adjustable between predetermined minimum and maximum positions, said film capable of deflection so as to contact said surface means to block of said open pores said maximum position of said chamber means corresponding to minimum contact relation between said film and said surface means and further corresponding to a maximum flame height, and said minimum position of said chamber means corresponding to maximum contact relation between said microporous film and said surface means and further corresponding to a minimum flame height.

8. The lighter of claim 7 wherein said conducting means comprises a centrally located aperture extending from said surface means to said valve means for conducting said fuel to said burner means, and said surface means further comprises one or more grooves extending in a ray-like manner from said centrally located aperture.

9. The lighter of claim 8 wherein said grooves have a substantially V-shaped cross-section.

10. The lighter of claim 7 wherein said conducting means comprises passage means extending from said the downstream side of said chamber means to said burner means to conduct fuel which has passed through the open pores of said film.

11. The lighter of claim 10 wherein said surface means further comprises one or more grooves extending in a ray-like manner from the center of said surface means to provide a predetermined minimum flame height.

12. The lighter of claim 11 wherein said grooves have a substantially V-shaped cross-section.

13. The lighter of claim 7 wherein said micropores of said film have a slot-like configuration and a cross-sectional area of about 0.04 by 0.4 micrometers.

14. The lighter of claim 7 wherein said fuel is butane or isobutane.

15. A fuel burning lighter having an adjustable height comprising:

burner means;

a supply of liquified gaseous fuel;

valve means positioned between said fuel supply and said burner means;

a microporous film having top and bottom generally parallel surfaces and micropores oriented substantially perpendicular to said surfaces, a plurality of said micropores being open to allow passage of fuel therethrough, said film positioned between said valve means and said fuel supply in such a manner so that all fuel flowing to said burner means must pass through open micropores;

means for conducting fuel passing through said film and through said valve means to said burner means; and means for adjusting the flame height comprising chamber means having adjustable depth and located downstream of said film, the upstream portion of said chamber means being defined by said film and the downstream portion defined by surface means and said conducting means; and means for selectively adjusting said depth of said chamber means between minimum and maximum positions permitting correspondingly minimum and maximum amounts of fuel to pass through said film, respectively, corresponding to respective minimum and maximum flame heights;

said film capable of deflection between said minimum and maximum positions for contact with said surface means to block a portion of said open pores and control the amount of fuel passing therethrough.

16. The lighter of claim 15 wherein said supply of fuel comprises a first liquid portion, a gaseous portion, and a second liquid portion in the form of a thin liquid film which continuously forms on the upstream surface of said microporous film as long as the lighter is operated with said valve means opened, wherein fuel contained in said thin liquid film subsequently passes through said microporous film and is substantially completely vaporized as it enters said conducting means.

17. A fuel burning lighter having adjustable flame height comprising:

burner means;

a supply of liquified gaseous fuel;

valve means positioned between said fuel supply and said burner means;

a film having top and bottom generally parallel surfaces and micropores oriented substantially perpendicular to said surface, a plurality of said micropores of said film being open to allow passage of fuel, said film positioned between said valve means and said fuel supply in such a manner so that all fuel flowing to said burner means must pass through said open micropores and said film being deflectable between a rest position and a deflected position;

means for conducting fuel passing through said film through said valve means to said burner means; and control means movable to positions corresponding to increased or decreased contact relation with said film when said film is in said deflected position so as to selectively increase or decrease said plurality of open micropores of said film, thus increasing or decreasing the passage of fuel through said film, thereby controlling the amount of fuel to said burner means to provide a flame of desired height;

wherein said supply of fuel comprises a first liquid portion, a gaseous portion, and a second liquid portion in the form of a thin liquid film which continuously forms on the upstream surface of said microporous film as long as the lighter is operated with said valve means opened, wherein fuel contained in said thin liquid film subsequently passes through said microporous film and is substantially completely vaporized as it enters said conducting means.

* * * * *